US010159397B2

(12) United States Patent
Citak et al.

(10) Patent No.: US 10,159,397 B2
(45) Date of Patent: Dec. 25, 2018

(54) DISHWASHER WIRE RACK PROVIDED WITH A CARRIER ADAPTOR STRUCTURE

(71) Applicant: ARCELIK ANONIM SIRKETI, Istanbul (TR)

(72) Inventors: Tumay Citak, Istanbul (TR); Ismail Cem Bastuji, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/553,944

(22) PCT Filed: Feb. 26, 2015

(86) PCT No.: PCT/EP2015/054067

§ 371 (c)(1),
(2) Date: Aug. 25, 2017

(87) PCT Pub. No.: WO2016/134780

PCT Pub. Date: Sep. 1, 2016

(65) Prior Publication Data

US 2018/0035865 A1 Feb. 8, 2018

(51) Int. Cl.
*A47G 19/08* (2006.01)
*A47L 15/50* (2006.01)

(52) U.S. Cl.
CPC ..... *A47L 15/505* (2013.01)

(58) Field of Classification Search
CPC ..... A47L 15/505; A47L 15/50; A47L 15/502; A47L 15/503; A47L 15/501
USPC ..... 211/41.8, 41.9; D32/3, 25; 248/309.1, 248/311.2, 311.3, 312, 312.1
See application file for complete search history.

(56) References Cited

U.S. PATENT DOCUMENTS 3,612,285 A * 10/1971 Mason ..... A47L 15/503 211/41.8
4,589,556 A * 5/1986 Peretz ..... A47L 15/505 211/41.2
5,249,590 A * 10/1993 Jacobus ..... A47L 15/505 134/135
5,971,167 A * 10/1999 Finbow ..... A47G 23/0208 206/426

(Continued)

FOREIGN PATENT DOCUMENTS

CA 2954302 A1 * 3/2016 ..... A47L 15/505
DE 1945681 U 9/1966

(Continued)

OTHER PUBLICATIONS

International search report and written opinion, dated Apr. 23, 2015, of International Application No. PCT/EP2015/054067; 7 pgs.

*Primary Examiner* — Jennifer E. Novosad
(74) *Attorney, Agent, or Firm* — Kilpatrick Townsend & Stockton LLP

(57) ABSTRACT

A dishwasher is provided that includes a carrier structure adapted to be mounted on the wire rack thereof for carrying wine glasses and the like. More particularly, the dishwasher includes a washing process chamber to place various kitchenware and cooking equipment to be washed and a spraying system spraying water to effect washing. The dishwasher further comprises a dishwasher rack in the form of a wireframe structure located in the washing process chamber.

9 Claims, 3 Drawing Sheets

(56) References Cited

Figure 1:
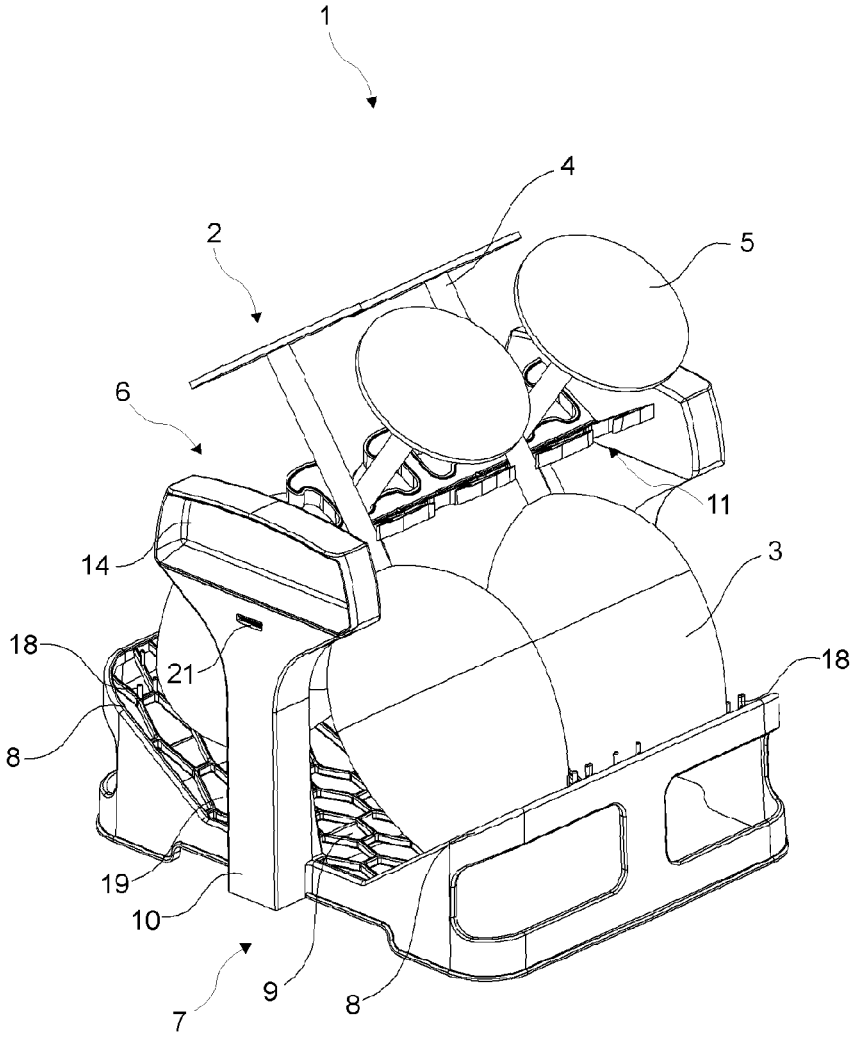

U.S. PATENT DOCUMENTS 6,109,455 A * 8/2000 Schroeder ..... A47L 15/505 211/41.9
6,123,204 A * 9/2000 Nelson ..... A47L 15/505 211/41.9
7,543,712 B2 * 6/2009 Purushothaman .... A47L 15/505 211/41.8
D605,909 S * 12/2009 Wax ..... D7/704
7,766,175 B2 * 8/2010 Jadhav ..... A47L 15/505 211/41.9
D630,396 S * 1/2011 Yang ..... D32/55
7,988,107 B2 * 8/2011 Miller ..... A47L 15/505 211/100
D680,828 S * 4/2013 Decker ..... D7/705
D706,009 S * 5/2014 Cooper ..... D32/55
8,789,711 B2 * 7/2014 Haltmayer ..... A47L 15/503 211/41.9
D773,752 S * 12/2016 Suh ..... D32/3
D774,712 S * 12/2016 Seo ..... D32/3
2005/0236345 A1 * 10/2005 Herbst ..... A47L 15/503 211/41.9
2006/0113260 A1 * 6/2006 Purushothaman .... A47L 15/505 211/41.8
2006/0138064 A1 * 6/2006 Crudgington, Jr. ... A47L 15/505 211/41.9
2006/0185698 A1 8/2006 Adasch
2007/0125729 A1 * 6/2007 Krueger ..... A47G 23/0208 211/60.1
2008/0135505 A1 * 6/2008 Frankel ..... A47L 19/04 211/41.4
2008/0185352 A1 * 8/2008 O'Hara ..... A47L 19/02 211/13.1
2009/0255888 A1 * 10/2009 Melvin ..... A47L 15/505 211/85.29
2011/0192808 A1 * 8/2011 Buhl ..... A47L 15/505 211/41.9
2012/0292273 A1 * 11/2012 McNamara ..... A47L 15/503 211/79
2014/0021149 A1 * 1/2014 Eng ..... A47L 15/505 211/41.8
2016/0037997 A1 * 2/2016 Mesa ..... A47L 15/503 134/166 R
2017/0258294 A1 * 9/2017 Mesa ..... A47L 15/505
2018/0035865 A1 * 2/2018 Citak ..... A47L 15/505

FOREIGN PATENT DOCUMENTS

DE 9407327 U1 7/1994
DE 10106763 A1 * 8/2002 ..... A47L 15/503
DE 10106763 A1 8/2002
DE 102014208667 A1 * 11/2015 ..... A47L 15/505
EP 1384431 A2 1/2004
WO WO-2010059136 A1 * 5/2010 ..... A47B 77/14
WO WO-2013045543 A1 * 4/2013 ..... A47L 15/503
WO WO-2016000791 A1 * 1/2016 ..... A47L 15/505
WO WO-2016134780 A1 * 9/2016 ..... A47L 15/505
WO WO-2016192792 A1 * 12/2016 ..... A47L 15/505

* cited by examiner

DISHWASHER WIRE RACK PROVIDED WITH A CARRIER ADAPTOR STRUCTURE

RELATED APPLICATIONS

This application is a U.S. National Phase of International Application No. PCT/EP2015/054067, filed Feb. 26, 2015, the entire disclosure of which is incorporated by reference herein.

The present invention relates to a dishwasher comprising a carrier structure adapted to be mounted on the wire rack thereof for carrying wine glasses and the like.

Wine glasses placed in the dishwasher rack have may fall due to displacements of the rack within the dishwasher. Dishwashers of the art are equipped with different kinds of racks and units especially designed for cutleries.

A carrier adaptor for the dishwasher rack unit in the form of an additional unit to be placed on the dishwasher rack to store wine glasses and the like may have the disadvantage of occupying unnecessary space when not in use.

A prior art publication relevant in the technical field of the present invention may be referred to as EP1384431 among others, the document disclosing a rack of a dishwasher comprising at least one side wall and at least one shelf connected with the at least one side wall and arranged in at least one working position in such a way as to form with the bottom plane of the rack at least one first angle (A, B) smaller than a right angle. The rack comprises at least a cutlery holder support comprising holes for the housing of cutlery and wide areas for the flow of the washing water and/or the flow of drying air. The cutlery holder support is located in proximity of the shelf and it is revoltingly connected with at least one side wall of the rack. The cutlery holder in working position forms with the bottom plane of the rack a second angle (C) different from the at least one first angle (A, B) and smaller than a right angle.

The present invention provides a removable carrier adaptor structure for dishwasher rack units specially designed for wine glasses. The carrier adaptor unit being removable provides an advantageous structure that does not occupy extra space when not in use. It presents a storing/placement alternative for the consumer. It also provides a balanced and stable storing option for wine glasses so as to occupy less space.

The fact that the dishwasher rack unit is a removable structure also allows use thereof outside the dishwasher as a temporary storage medium carrying glasses and other kitchenware and allows placement of the same conveniently into the dishwasher when the washing process is to be carried out.

Additionally, the dishwasher rack unit of the invention can perform storage function for alternative kitchenware, advantageously providing extra space for such other items when the rack unit is not used for storing wine glasses.

The present invention therefore provides a rack unit particularly for wine glasses and other glasses comprising a lower base part separated from the upper bowl section by the stem thereof as defined by the characterizing features in Claim 1 and subsequent Claims.

Primary object of the present invention is hence to provide a rack unit comprising a carrier section particularly for wine glasses ensuring that no unnecessary space is employed when not in use, while at the same time providing alternative placement options and/or stable support for wine glasses.

The present invention provides a dishwasher with a dishwasher rack unit that is removably placed on the dishwasher rack. The unit is specially designed to support stems of wine glasses and the like by an upper receiving section and bowl sections thereof by a base section.

A dishwasher comprising a removable rack unit is proposed. The rack unit comprises a receiving section with two lateral receiving section panels longitudinally suspended between two upright stand portions Each receiving section panel comprises a plurality of alignment openings firmly receiving stems of wine glasses while bowl sections thereof are supported on a rack base portion in an inclined manner.

Each of the receiving section panels is inclined with respect to the rack base's bottom surface such that the sum of the two angles amount to 180 degrees. Likewise, the rack base's two supporting regions around a flat region are respectively inclined to extend parallel to the respective receiving section panel.

Each alignment opening has consecutive resting cavities into which stems of the wine glasses are received.

A restriction forms is disposed between two neighboring alignment openings, each restriction form comprising two restriction cavities around a central portion of the restriction form, the central portion projecting from between two neighboring alignment openings.

Each restriction cavity is oppositely situated to a respective resting cavity in the outward direction from the resting cavity so that further outward displacement of a wine glass stem is prevented. The distance r from the center of the semi-circular resting cavity to a release line perpendicular to the longitudinal axis of the receiving section and extending from a first point of the restriction form along the shortest line (d) between two neighboring restriction forms to a second point proximate the resting cavity is greater than the radius of the semi-circular resting cavity.

Further, a separator is provided between two resting cavities of an alignment opening. The separator serving for partially blocking displacement of the wine glass stems in a direction parallel to the longitudinal axis of the receiving section. The same effect is also provided by lateral tip portions of the restriction forms that extend inwardly in the direction of the separator.

Accompanying drawings are given solely for the purpose of exemplifying a dishwasher rack unit comprising an improved carrier adaptor structure wire rack, whose advantages over prior art were outlined above and will be explained in brief hereinafter.

The drawings are not meant to delimit the scope of protection as identified in the claims nor should they be referred to alone in an effort to interpret the scope identified in the claims without recourse to the technical disclosure in the description of the present invention.

FIG. 1 demonstrates a general perspective view of a rack unit according to the present invention.

Figure 2:
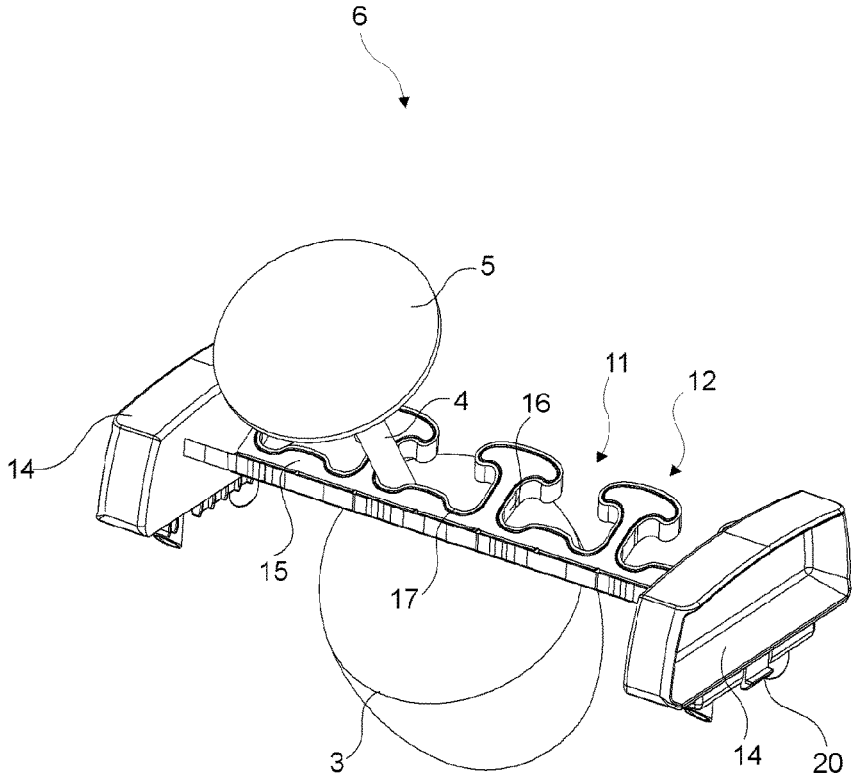

FIG. 2 demonstrates a general perspective view of a receiving section accommodating a wine glass according to the present invention.

Figure 3:
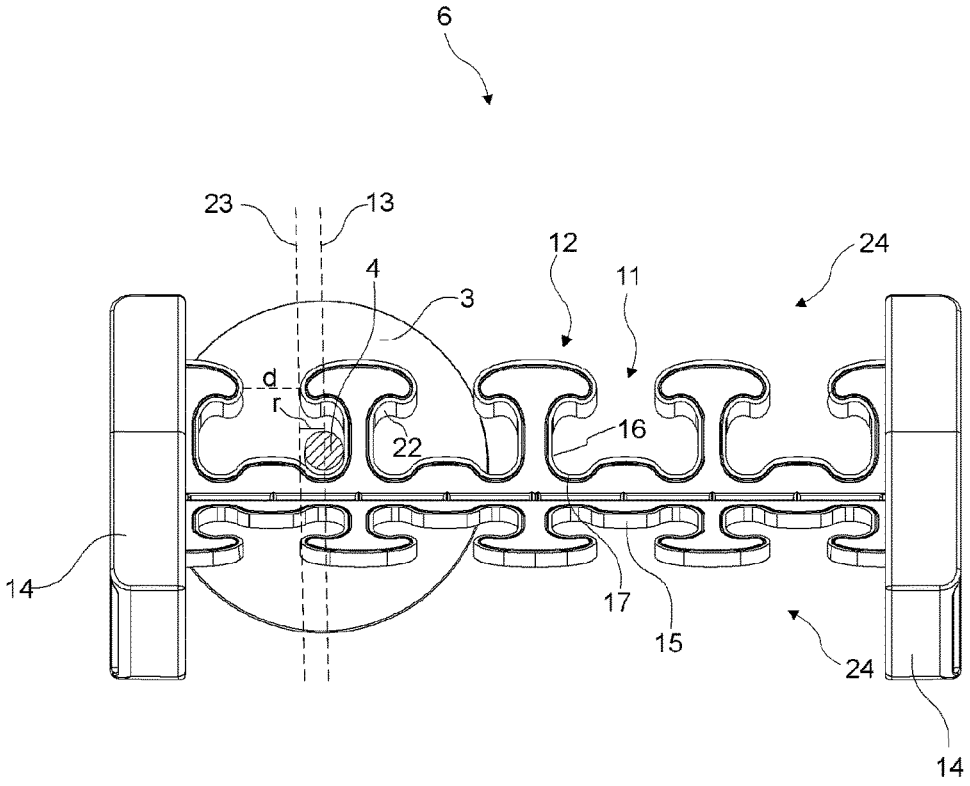

FIG. 3 demonstrates a top view of a receiving section according to the present invention.

The following numerals are assigned to different parts demonstrated in the drawings:

1. Rack unit
2. Wine glass
3. Bowl section
4. Stem
5. Base part
6. Receiving section
7. Rack base
8. Supporting region

9. Flat region
10. Stand portion
11. Alignment opening
12. Restriction form
13. Translocation axis
14. Handle portion
15. Separator
16. Perpendicular wall
17. Resting cavity
18. Pin portion
19. Grids
20. Tab connection means
21. Tab connection opening
22. Restriction cavity
23. Release line
24. Receiving section panel The present invention provides a dishwasher conventionally defining a washing process chamber and a spraying system spraying water to effect washing of the various kitchenware and cooking equipment placed in the dishwasher. The dishwasher typically has a dishwasher rack in the form of a wireframe structure located in the washing process chamber. The dishwasher rack has a multitude of tines on the bottom being disposed in rows from front to back of the wireframe structure. The rack unit (1) of the invention can be placed on the dishwasher rack so as to create additional space for carrying and storing glasses and particularly wine glasses (2) and the like comprising a lower base part (5) separated from the upper bowl section (3) by the stem (4).

The present invention provides a removable dishwasher rack unit (1) for wine glasses (2), comprising a rack base (7) and a receiving section (6) connected to a pair of stand portions (10) perpendicularly extending at opposite sides of the rack unit (1). The rack base (7) provides a standing base for placement of the wine glasses (2). The receiving section (6) supports and retains the wine glasses (2) by way of receiving stems (4) thereof.

The wine glasses (2) are placed upside down on the dishwasher rack unit (1). The bowl section (3) of the glass is placed on the rack base (7) and the stems (4) thereof are leaned on an alignment opening (11) in a supported manner within the receiving section (6). The alignment opening (11) of the receiving section (6) is shaped to receive the stems (4) of the wine glasses (2). The alignment openings (11) have individual semi-circular edge portions arranged consecutively extending along the edge line. A perpendicular wall (16) extends along alignment openings (11) and around restriction forms (12) that project from between the alignment openings (11). The alignment openings (11) and restriction forms (12) therefore consecutively extend along each lateral side of the receiving section (6) forming a receiving section panel (24) so as to provide a plurality of resting cavities (17) receiving and retaining stems (4) of the wine glasses (2) in a supporting manner.

The restriction form (12) therefore encloses a plurality of stems (4) of the wine glasses (2) to accommodate the same within an alignment opening (11) comprises resting cavities (17). This placement ensures storage of the wine glasses (2) in a stable manner without obstructing each other. The restriction form (12) further provides additional support to avoid accidental displacement of a glass stem (4) outwardly from inside the alignment opening (11) while the rack unit (1) is being carried.

The stem (4) portion of a wine glass (2) leaning on a resting cavity (17) within the alignment opening (11) is therefore supported by the perpendicular wall (16) of the resting cavity (17) whose shape is adapted to support a certain longitudinal length of the stem (4). Likewise, the semi-circular shape of the resting cavity (17) enclosing a certain peripheral length of the stems (4) provides a stable contact relationship firmly holding wine glasses (2) whereby displacement of the wine glasses (2) during movement of the rack unit (1) is prevented.

A translocation axis (13) perpendicular to the longitudinal axis of the receiving section (6) is defined by a displacement line of the glass stem (4) when it moves away from the resting cavity (17) in the outward direction passing from the center of the resting cavity (17). Movement along the translocation axis (13) leads to an oppositely situated restriction cavity (22) of the restriction form (12). Each restriction form (12) therefore has two restriction cavities (22) extending around a central portion of the restriction form (12) projecting from between two neighboring alignment openings (11). Each restriction cavity (22) facing a respective resting cavity (22) therefore prevents release of the glass stem (4) from inside the inner region defined by two neighboring restriction form (12) thereinbetween.

In the event that the glass stem (4) moves in a different direction deviating from the translocation axis (13) towards a release line (23), it might be possible that it moves out from the alignment opening (11) and fall out. To prevent this and to ensure retainment of the glass within a respective resting cavity (17) of the alignment opening (11), the present invention proposes two separate embodiments as will be delineated hereinafter.

According to the invention, the distance r between the translocation axis (13) and the release line (23) perpendicular to the longitudinal axis of the receiving section (6) is greater than the radius of the semi-circular resting cavity (17). The release line (23) extends from a first point of the restriction form (12) along the shortest line (d) between two neighboring restriction forms (12) to a second point proximate the resting cavity (17). The distance r being greater than the radius of the semi-circular resting cavity (17) ensures that the glass stem (4) is stopped by the restriction cavity (22) when moving through the translocation axis (13).

Further, deviation from the translocation axis (13) in the direction of the release line (23) is prevented either by a separator (15) adjacently positioned to two resting cavities (17) thereinbetween in the alignment opening (11) or by the lateral tip portions of the restriction forms (12). The separator (15) is in the form of a portion projecting from between the two resting cavities (17) in the direction of the mouth portion of the alignment opening (11). The separator (15) therefore both prevents displacement of the glasses out of the resting cavities (17) and separates the wine glasses (2) in different resting cavities (17) to prevent contact of the same, thereby avoiding damage thereof during transportation of the rack unit (1). In short, the downward sloping communication of the separator (15) with the resting cavity (17) ensures retaining of the stems (4) within the resting cavities (17).

According to the invention, the rack base (7) comprises a flat region (9) and a pair of supporting regions (8) facing each other. The supporting regions (8) form lateral planes around the longitudinal axis of the receiving section (6), by which bowl sections (3) of the wine glasses (2) placed thereon in an inclined manner with respect to the horizontal axis are supported on the surface. The supporting regions (8) as well as the flat region (9) are structured to have grids (19) to allow water flow and receive tines of the dishwasher rack.

These grids (19) may be designed in preferred sizes and shapes to fit to the dishwasher rack comprising tines to support plates or glasses.

The receiving section (6) is connected to two handle portions (14) at the opposite longitudinal sides thereof providing users ease of grip during transportation or replacement of the rack unit (1). The receiving section (6) is connected to the stand portions (10) by means of a pair of tab connection means (20) situated under the two handle portions (14) to be engaging with tab connection openings (21) positioned on the stand portion (10) surfaces.

The rack unit (1) further comprises pin portions (18) integral with the grids (19) of the inclined supporting regions (8) near the edges thereof at both sides of the longitudinal receiving section (6) axis. These pin portions (18) provide support for the bowl sections (3) of wine glasses (2) to avoid dislocation of the bowl sections (3) beyond the edges of the supporting regions (8).

The rack unit (1) of the present invention is removable. It is not attached to the dishwasher or the dishwasher rack it is placed on. It can alternatively be placed on other surfaces to act as a storing unit for wine glasses (2) or other kitchenware, such as a drainer to be placed next to the sink.

In summary, the present invention provides a dishwasher comprising a washing process chamber to place various kitchenware and cooking equipment to be washed and a spraying system spraying water to effect washing. The dishwasher further comprises a dishwasher rack in the form of a wireframe structure located in the washing process chamber.

In one embodiment of the present invention, a rack unit (1) is removably placed on the dishwasher rack. The rack unit (1) comprises a rack base (7) and a receiving section (6), the receiving section (6) being perpendicularly mounted to two stand portions (10) at both sides thereof in a centrally suspended position. The receiving section (6) comprises a plurality of alignment openings (11) into which stems (4) of wine glasses (2) are receivable while bowl sections (3) thereof are rested on the rack base (7) in the manner to direct the stems (4) into the alignment openings (11).

In a further embodiment of the present invention, the receiving section (6) is structured to have two receiving section panels (24) extending around the longitudinal axis of the receiving section (6). Each receiving section panel (24) comprises a different angle with respect to the rack base's (7) bottom surface and the sum of the two angles amounting to 180 degrees.

In a further embodiment of the present invention, the rack base (7) comprises a flat region (9) and a pair of supporting regions (8) around the same facing each other.

In a further embodiment of the present invention, each of the supporting regions (8) extends parallel to a respective receiving section panel (24). This configuration ensures that the base parts (5) of the wine glasses (2) are directed inwardly to lean on the receiving section panels (24) where the stem (4) portions thereof are retained by the alignment openings (11), thereby supporting a wine glass in an inwardly inclined hence more reliable as well firmly retained manner.

In a further embodiment of the present invention, bowl sections (3) of wine glasses (2) are placed on the supporting regions (8) in an inclined manner with respect to the rack base's (7) bottom surface.

In a further embodiment of the present invention, stems (4) of wine glasses (2) are leanable on resting cavities (17) consecutively arranged within the alignment openings (11), the resting cavities (17) in the form of semi-circular edge portions adapted to enclose a certain peripheral length of the stem (4) to retain the same in a supported manner. A reliable retaining effect is obtained by the semi-circular edge portions enclosing a certain peripheral length of the stem (4).

In a further embodiment of the present invention, restriction forms (12) project from between the alignment openings (11), alignment openings (11) and restriction forms (12) being consecutively arranged along each receiving section panel (24).

In a further embodiment of the present invention, each restriction form (12) has two restriction cavities (22) extending around a central portion of the restriction form (12). The central portion projecting from between two neighboring alignment openings (11).

In a further embodiment of the present invention, each restriction cavity (22) is oppositely situated to a respective resting cavity (17) facing the same whereby movement of a wine glass (2) stem (4) along a translocation axis (13) perpendicular to the longitudinal axis of the receiving section (6) and passing from the center of the semi-circular resting cavity (17) is prevented. In brief, each restriction cavity (22) being oppositely situated to a respective resting cavity (17) in the outward direction from the resting cavity (17) prevents further displacement of a wine glass (2) stem (4) outwardly.

In a further embodiment of the present invention, the distance r between the translocation axis (13) and a release line (23) perpendicular to the longitudinal axis of the receiving section (6) and extending from a first point of the restriction form (12) along the shortest line (d) between two neighboring restriction forms (12) to a second point proximate the resting cavity (17) is greater than the radius of the semi-circular resting cavity (17).

In a further embodiment of the present invention, a separator (15) in the form of a portion projecting from between two neighboringly positioned resting cavities (17) in an alignment opening (11) in the direction of the mouth portion of the alignment opening (11) is provided whereby movement of a wine glass (2) stem (4) in the direction of the release line (23) is prevented. A separator (15) between two resting cavities (17) of an alignment opening (11) therefore serves for partially blocking displacement of the wine glass (2) stems (4) in a direction parallel to the longitudinal axis of the receiving section (6).

In a further embodiment of the present invention, lateral tip portions of the restriction forms (12) extend inwardly in the direction of the separator (15).

In a further embodiment of the present invention, the supporting regions (8) and the flat region (9) are structured to have grids (19).

In a further embodiment of the present invention, the receiving section (6) is connected to two handle portions (14) at longitudinal sides thereof. The handle portions (14) being in mechanical communication with the stand portions (10).

In a further embodiment of the present invention, a dishwasher rack unit (1) for removably placing on a dishwasher rack of a dishwasher is provided. The rack unit (1) comprises a rack base (7) and a receiving section (6), the receiving section (6) being perpendicularly mounted to two stand portions (10) at both sides thereof in a centrally suspended position. The receiving section (6) comprises a plurality of alignment openings (11) into which stems (4) of wine glasses (2) are receivable while bowl sections (3) thereof are rested on the rack base (7) in an inclined manner to direct the stems (4) into the alignment openings (11).

The present invention therefore provides a rack unit (1) comprising a carrier section particularly for wine glasses (2) to be retained in a firm manner and ensuring that no unnecessary space is employed when not in use, while at the same time providing alternative placement options and/or stable support for wine glasses.

The invention claimed is:

1. A dishwasher comprising:

a washing process chamber to place kitchenware and cooking equipment to be washed;

a spraying system spraying water to effect washing;

a dishwasher rack in the form of a wireframe structure located in the washing process chamber; and a rack unit removably placed on the dishwasher rack, comprising:

a rack base;

two stand portions; and a receiving section, the receiving section being perpendicularly mounted to the two stand portions at both sides thereof in a centrally suspended position the receiving section structured to have two receiving section panels extending around a longitudinal axis of the receiving section, wherein each receiving section panel from the two receiving section panels comprises:

a plurality of alignment openings into which stems of wine glasses are receivable while bowl sections thereof rest on the rack base in a manner to direct the stems into the alignment openings, wherein each alignment opening from the plurality of alignment openings comprises:

two semi-circular resting cavities consecutively arranged within the alignment opening, each semi-circular resting cavity having the form of a semi-circular edge portion adapted to enclose a certain peripheral length of a wine glass stem to retain the wine glass stem in a supported manner; and a plurality of restriction forms, each restriction form projecting from between two neighboring alignment openings from the plurality of alignment openings, the plurality of alignment openings and the plurality of restriction forms being consecutively arranged along the receiving section, wherein each restriction form from the plurality of restriction forms comprises:

two restriction cavities extending around a central portion of the restriction form, each restriction cavity being oppositely situated to a respective semi-circular resting cavity facing the same whereby movement of a stem along a translocation axis perpendicular to the longitudinal axis of the receiving section and passing from the center of the semi-circular resting cavity is prevented, wherein each restriction cavity extends so that a distance r is greater than a radius of the semi-circular resting cavity, the distance r being defined as the distance between the translocation axis and a release line perpendicular to the longitudinal axis of the receiving section and extending from a first point of the restriction form along a shortest line between two neighboring restriction forms to a second point proximate the resting cavity.

2. The dishwasher as in claim 1, wherein each receiving section panel comprises a different angle with respect to a bottom surface of the rack base and a sum of the two angles amounting to 180 degrees.

3. The dishwasher as in claim 2, wherein the rack base comprises:

a flat region; and a pair of supporting regions around the flat region, the pair of supporting regions facing each other.

4. The dishwasher as in claim 3, wherein each of the supporting regions extend parallel to a respective receiving section panel.

5. The dishwasher as in claim 3, wherein the supporting regions are inclined with respect to the flat region.

6. The dishwasher as in claim 3, wherein the supporting regions and the flat region are structured to have grids.

7. The dishwasher as in claim 1, wherein each alignment opening from the plurality of alignment openings further comprises:

a separator in the form of a portion projecting from between two neighboringly positioned semi-circular resting cavities in a direction of a mouth portion of the alignment opening, whereby movement of a wine glass stem in a direction of the release line is prevented.

8. The dishwasher as in claim 7, wherein lateral tip portions of the restriction forms extend inwardly in a direction of the separator.

9. The dishwasher as in claim 1, wherein the rack unit further comprises:

two handle portions, each handle portion being in mechanical communication with a respective stand portion, wherein the receiving section is connected to the two handle portions at longitudinal sides thereof.

* * * * *